US007793592B2

(12) United States Patent
Hofmann et al.

(10) Patent No.: US 7,793,592 B2
(45) **Date of Patent: *Sep. 14, 2010**

(54) MICROELECTRONIC PYROTECHNICAL COMPONENT

(75) Inventors: Achim Hofmann, Polling (DE); Horst Laucht, Bruckmühl (DE)

(73) Assignee: TRW Airbag Systems GmbH, Aschau Inn (DE)

( * ) Notice: Subject to any disclaimer, the term of this patent is extended or adjusted under 35 U.S.C. 154(b) by 1102 days.

This patent is subject to a terminal disclaimer.

(21) Appl. No.: 10/360,497

(22) Filed: Feb. 6, 2003

(65) Prior Publication Data

US 2003/0145758 A1 Aug. 7, 2003

(30) Foreign Application Priority Data

Feb. 6, 2002 (DE) ..... 102 04 833

(51) Int. Cl.
*C06D 5/00* (2006.01)
*C06B 45/12* (2006.01)

(52) U.S. Cl. ..... 102/530; 149/14

(58) Field of Classification Search ..... 102/530; 149/14

See application file for complete search history.

(56) References Cited

U.S. PATENT DOCUMENTS

| | | | |
|---|---|---|---|
| 2,777,389 | A | 1/1957 | Lawrence |
| 3,763,783 | A | 10/1973 | Thomas et al. |
| 4,928,991 | A | 5/1990 | Thorn |
| 6,431,594 | B1 | 8/2002 | Swann et al. |
| 6,584,911 | B2 | 7/2003 | Bergerson et al. |
| 6,598,899 | B2 | 7/2003 | Stonich et al. |
| 6,619,692 | B2 | 9/2003 | VanWynsberghe et al. |
| 6,641,074 | B2 | 11/2003 | Shih et al. |

FOREIGN PATENT DOCUMENTS

| | | |
|---|---|---|
| DE | 3842917 | 11/1989 |
| DE | 19815928 | 11/1999 |
| DE | 101 62 413 | 7/2003 |
| EP | 0903487 | 3/1999 |

OTHER PUBLICATIONS

Article entitled "Advanced Materials", 2002, 14, No. 1, pp. 38-41.*

University of California, San Diego: External Relations: News and Information: News Release, Jan. 9, 2002, pp. 1-2.*

(Continued)

*Primary Examiner*—Jerry Lorengo
(74) *Attorney, Agent, or Firm*—Tarolli, Sundheim, Covell & Tummino LLP

(57) ABSTRACT

A component of a safety system in motor vehicles comprises a core which has end and side faces and is made of an explosive material. The component further comprises a jacket made of a solid semiconductor material that surrounds the explosive material on the side faces of the core, and an ignition element situated between electric contact surfaces on one of the end faces of the core. The ignition element initiates an ignition of the explosive material when current flows through it. The explosive material consists of a porous fuel and of an oxidizer incorporated into the porous fuel. The porous fuel and the solid semiconductor are made of the same material.

22 Claims, 3 Drawing Sheets

OTHER PUBLICATIONS

Physical Review Letters, vol. 87, Nr. 6, pp. 068301-1 to 068301-4.*
U.S. Appl. No. 09/755,704, filed Jan. 5, 2001 entitled "Air Bag Inflator".
Tayebi, Abdelkader, K. http://www.people.cornell.edu/pages/aktl/whathtml "MEMS Virtual Learning Cybercent and E(du) Pages, So What Are These MEMS" Copyright 1998.
Janson et al. "MEMS Microengineering and Aerospace Systems"—AIAA 99-3802, Copyright 1999.
Article, D. Lewis et al. "Digital Micropulsion", California Institute of Technology, Mar. 2000.
"Digital Propulsion Microthrusters" The Aerospace Corporation Preliminary Design Review, Jun. 27, 1999.

* cited by examiner

MICROELECTRONIC PYROTECHNICAL COMPONENT

TECHNICAL FIELD

The invention relates to a microelectronic pyrotechnical component, especially for use in safety systems in vehicles. Specifically, the component is an igniter or a gas generator for use in airbag modules or belt tensioners.

BACKGROUND OF THE INVENTION

Igniters for gas generators of the conventional type consist of a housing sealed off with a base and of ignition agents incorporated in the housing, the ignition agents being ignited by a glow wire, a thin-film element or a semiconductor bridge. The ignition means are frequently made up of a primary charge and a booster charge with which the actual gas-generating mixture is made to ignite. Igniters of this type cannot be miniaturized because of their design principle. Therefore, they sometimes no longer meet the demands of the automotive industry for components that take up little installation space.

DE 198 15 928 A1 discloses a semiconductor igniter for use in a gas generator for safety systems in vehicles, with a semiconductor layer that is situated on a carrier with a thermal insulating layer in-between, whose end is connected to electric contact areas and that heats up when current passes through the ignition segment area, thereby initiating the ignition. The thermal insulating layer is limited to the ignition segment area and preferably consists of porous silicon. In order to boost the ignition, an explosive gas or gas mixture can be incorporated into the porous silicon.

It is known from Physical Review Letters 87/6 (2001), pp. 068301/1 to 068301/4 that a spontaneous explosion occurs when liquid oxygen is brought together with porous silicon that has been produced by electrochemically etching silicon in an electrolyte containing hydrogen fluoride.

Adv. Mater., 2002, 14, No. 1, pp. 38 to 41 reports that only a freshly made, porous silicon mixed with gadolinium nitrate ($Gd(NO_3)_3.6H_2O$) can be made to explode through friction with a diamond tip or by an electrical spark discharge. The porous silicon mixed with gadolinium nitrate is used here as a source of energy for atom emission spectroscopy. Additional proposed applications pertain to the use as an actuator in micro-electromechanical systems.

In view of the foregoing, the invention is based on the object of providing a microelectronic-pyrotechnical component, especially for safety applications in vehicles, that is simply structured and that can be manufactured at low cost.

BRIEF SUMMARY OF THE INVENTION

According to the invention, a component of a safety system in motor vehicles comprises a core which has end and side faces and is made of an explosive material. The component further comprises a jacket made of a solid semiconductor material that surrounds the explosive material on the side faces of the core, and an ignition element situated between electric contact surfaces on one of the end faces of the core. The ignition element initiates an ignition of the explosive material when current flows through it. The explosive material consists of a porous fuel and of a solid or liquid oxidizer incorporated into the porous fuel. The porous fuel and the solid semiconductor are made of the same material and preferably consist of silicon; the silicon can be highly or slightly p-doped or n-doped.

On one of the end faces of the core, there can be arranged a membrane, i.e. a layer that is a few μm thick (e.g. 2 μm to 50 μm), which is made of a semiconductor material, with the jacket and the membrane being preferably made of the same semiconductor material and formed in one piece. As an alternative, the membrane can consist of another material that can easily be applied onto the semiconductor material of the jacket such as, for example, $SiO_2$. The membrane can be situated between the ignition element and the explosive material. It is particularly preferred that the ignition element is in direct contact with the explosive material. In this case, the ignition element and the membrane can be situated on end faces of the core that are opposite each other.

Moreover, the component has a cover that closes the ignition element or the explosive material in a gas-tight and liquid-tight manner. The cover and the membrane are preferably situated on opposite end faces of the core or of the component. The membrane and the cover can be dispensed with if the explosive material is stable vis-à-vis environmental influences.

In a first embodiment of the invention, the ignition element and the cover are situated on the same end face. In this case, the ignition element can also be situated on the cover so that a small gap remains between the ignition element and the explosive material. This allows the ignition element and the contact surfaces to be prefabricated on the cover in a separate process step, thereby ensuring especially efficient manufacturing.

In a further embodiment, the cover and the ignition element are located on opposite end faces of the component. The ignition element is then preferably situated on the membrane that is adjacent to the explosive material. Here, the cover serves to seal off the material on the other end face. This embodiment allows a design that is especially compact and safe to handle.

In a third embodiment of the invention, the cover with the ignition element has a membrane-like design, that is to say, the cover only has a small layer thickness in the μm range (2 μm to 50 μm). The ignition element is preferably situated on the inside of the cover. On the end face of the core opposite the cover, there is a thicker layer made of the solid semiconductor material of the jacket. This thicker layer is preferably formed in one piece with the jacket.

The cover can be made of any substances that can be joined to the semiconductor material. Preferably, the cover consists of semiconductor materials such as silicon, or of glass, ceramics or metal and it is connected to the semiconductor material or to the electric contact surfaces by means of conventional joining techniques such as anodic bonding, solder glass bonding, eutectic bonding, silicon direct bonding or conventional adhesion techniques.

The ignition element is preferably a semiconductor bridge, for example, of the type described in DE 198 15 928 A1, or a thin layer element of the kind disclosed, for instance, in WO-A 98/54535 and, when current passes through, it heats up suddenly, thus initiating the ignition of the explosive material.

The porous fuel is preferably a nanostructured material with a structure size that lies between about 2 nm and 1000 nm, preferably between 2 nm and 50 nm, and with a porosity, i.e. a ratio of the pore volume to the volume of the porous specimen ($V_{pores}/V_{specimen}$) that lies between 10% and 98%, preferably between 40% and 80%. The fuel can have a specific surface area of up to 1000 $m^2/cm^3$, preferably between 200 and 1000 $m^2/cm^3$.

It is particularly preferred that the fuel is a porous silicon that has been made by means of electrochemical etching of silicon in an electrolyte that contains fluoride. By tempering in air, there can be obtained a passivation of the porous silicon. When tempered in this manner, the porous silicon has an improved storage life.

Possible oxidizers that can be used are compounds or mixtures containing hydrogen peroxide, hydroxyl ammonium nitrate, organic nitro compounds or nitrates, metal nitrates, metal nitrites, metal chlorates, metal perchlorates, metal bromates, metal iodates, metal oxides, metal peroxides, ammonium perchlorate or ammonium nitrate. The fraction of the above-mentioned compounds in the oxidizer is preferably at least 50% by weight, especially preferably at least 70% by weight.

The oxidizer preferably consists entirely or partially of alkali metal nitrate or alkali metal perchlorate, earth alkali metal nitrate or earth alkali metal perchlorate, ammonium nitrate, ammonium perchlorate or mixtures thereof. Especially preferably, the oxidizer is an alkali metal nitrate or earth alkali metal nitrate, optionally in a mixture with ammonium perchlorate. These oxidizers are inexpensive, have a long storage life, are easily available and can be added to the porous silicon without problems and under controllable conditions.

Typical dimensions of the component according to the invention lie in the range from 0.5 mm to 5 mm in length and width, and the thickness ranges from 0.3 mm to 3 mm.

The component according to the invention is especially suitable as an igniter in safety systems in vehicles, for example, airbag modules or belt tensioners. It can advantageously be manufactured with processes known from silicon processing technology. In particular, a simple and inexpensive production with high precision is already possible in a batch process on the wafer level. The considerable pyrotechnical effect with minimal dimensions and compact design also allows the implementation of a multi-point ignition, which could not be achieved so far with the known systems. Moreover, one can dispense with secondary ignition agents for igniting the gas-generating propellant, which have been usual hitherto; the reasons for this are the high energy density and the high release of energy of the component. This makes possible a further miniaturization and reduction in weight. The component according to the invention can also be manufactured so as to be hermetically sealed and consequently, it is especially insensitive to environmental influences.

DETAILED DESCRIPTION OF THE PREFERRED EMBODIMENTS

Figure 1:
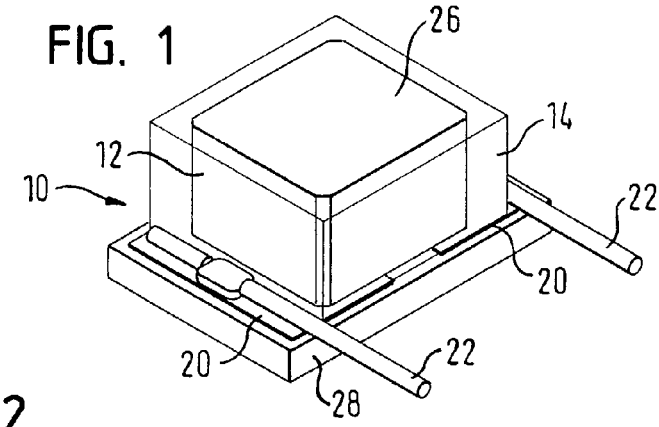
FIG. 1 is a schematic representation of a first embodiment of an igniter according to the invention.
Figure 2:
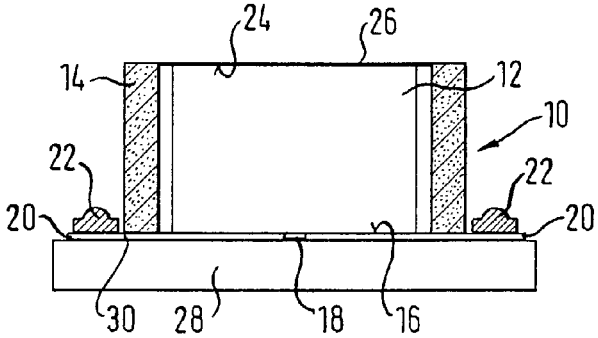
FIG. 2 shows the igniter from FIG. 1 in a cross-section.
Figure 3:
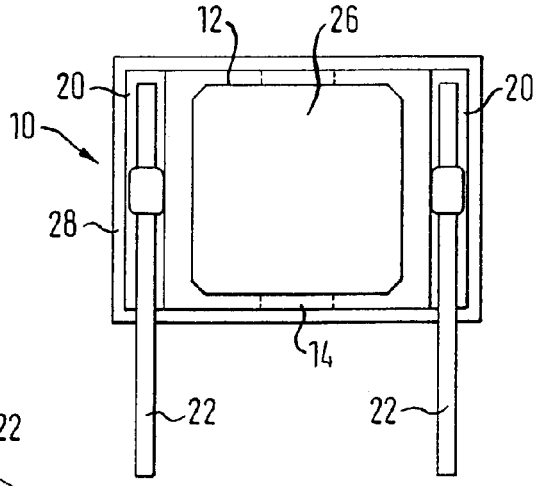
FIG. 3 is a top view of the igniter from FIG. 1 in a schematic representation.
Figure 4:
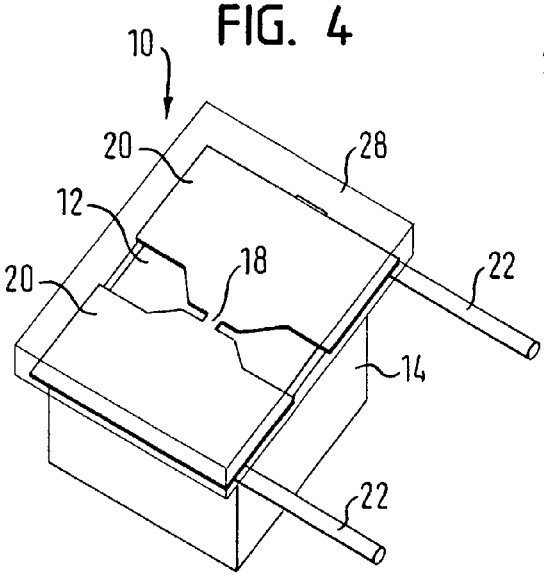
FIG. 4 is a bottom view of the igniter from FIG. 1 in a schematic representation.

The igniter 10 shown in FIGS. 1 to 4 has a core 12 made of an explosive material. The explosive material is preferably porous silicon with a structure size (size of the nanocrystals) that lies between 2 nm and 50 nm, and a porosity ($V_{pores}/V_{specimen}$) that lies between 40% and 80%. The porous silicon can be passivated by tempering in air. An oxidizing agent which is solid or liquid at room temperature is incorporated into the pores of the porous silicon. The oxidizing agent is preferably selected from the group of alkali metal nitrates and perchlorates, earth alkali metal nitrates and perchlorates, ammonium perchlorate and ammonium nitrate as well as mixtures thereof. Other oxidizing agents such as, for instance, organic nitro compounds or organic nitrates, can also be used.

The side faces of the core 12 made of the explosive material are surrounded by a jacket 14 made of a solid semiconductor material. The jacket 14 and the core 12 are made of the same semiconductor material and are preferably formed in one piece. That is to say, the jacket 14 preferably consists of solid silicon. The silicon can be slightly or highly p-doped or n-doped. The use of undoped silicon is also possible.

An ignition element 18 is situated on one of the end faces 16 of the core 12. The ignition element 18 is located between electric contact surfaces 20 which, in the embodiment shown here, extend beyond the core 12 and the jacket 14, and their ends are connected to leads 22 for electric contacts. The ignition element 18 is preferably in direct contact with the core 12 made of the explosive material and initiates an ignition of this material when current passes through it.

On the end face 24 of the core 12 opposite the end face 16, there is provided a membrane 26, that is to say, a thin layer that is only a few μm thick and that is made of the semiconductor material. The membrane 26 and the core 12 or the jacket 14 are made of the same semiconductor material and are formed with each other in one piece. Preferably the semiconductor material of the membrane 26 likewise consists of silicon. As an alternative, the membrane can also consist of $SiO_2$, which can easily be deposited on the semiconductor material of the jacket.

The ignition element 18 situated on the end face 16 of the core can be a semiconductor bridge or a thin layer element of a generally known type. The electric contact surfaces here can likewise be made of a semiconductor material, preferably silicon, although the doping and the conduction type of the contact surface material and of the materials of the core and of the jacket can be different. As an alternative, the contact surfaces can be sputtered on as metallic layers made, for example, of aluminum or gold. Preferably, the ignition element is sealed gas-tight and liquid-tight on the end face 16 by means of a cover 28. With this embodiment, the ignition element can also be situated on the inside of the cover 28, so that a narrow gap remains between the ignition element 18 and the core 12 made of the explosive material.

The cover 28 is preferably made of silicon, glass, ceramic or metal and is joined to the semiconductor material of the jacket 14 by means of conventional bonding, adhesion or other joining techniques, with the formation of a connection 30 which is hermetically sealed. The contact surfaces are implanted or sputtered on.

Figure 5:
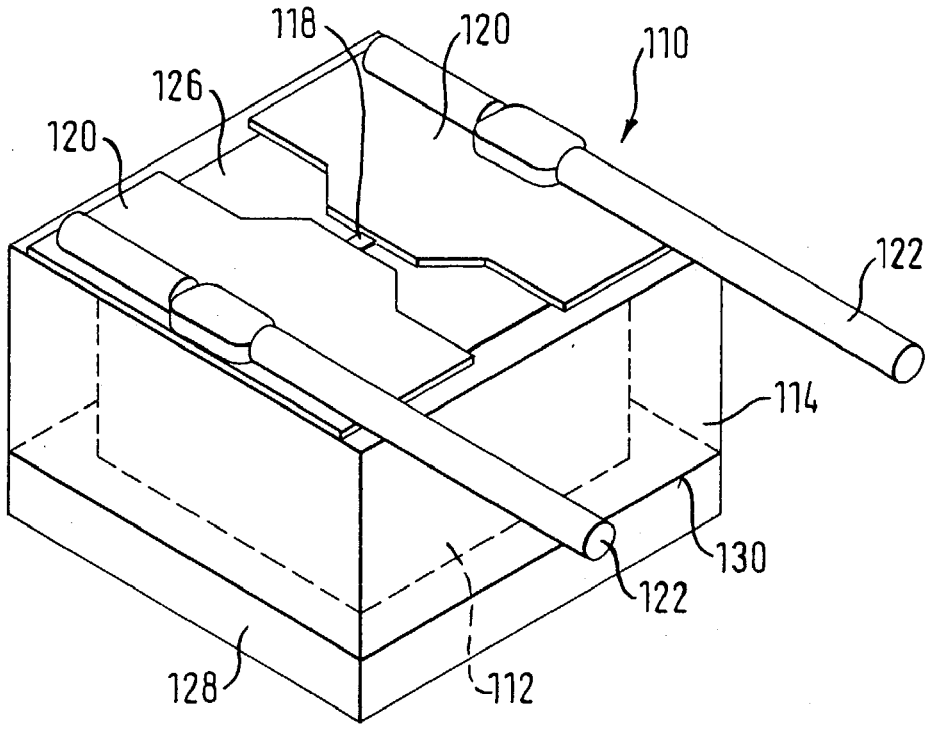
FIG. 5 is a schematic representation of a second embodiment of the igniter according to the invention.
Figure 6:
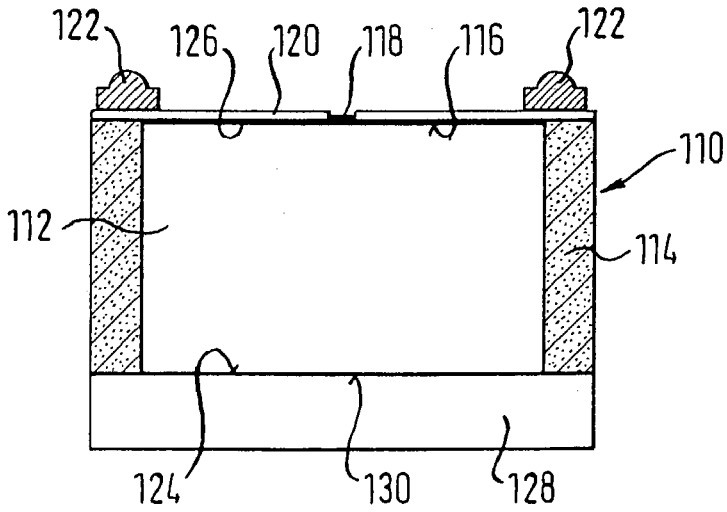
FIG. 6 shows the igniter according to the invention from FIG. 5 in a cross-section.

In the embodiment of the igniter 110 according to the invention shown in FIGS. 5 and 6, the core 112 made of the explosive material is likewise made of a porous semiconductor material, preferably porous silicon.

The porous silicon preferably has a structure size (size of the Si nanocrystals) measuring between 2 nm and 50 nm and a porosity ($V_{pores}/V_{specimen}$) that lies between 40% and 80%. A solid or liquid oxidizing agent is incorporated into the pores of the porous silicon at room temperature. The oxidizing agent is preferably selected from the group consisting of alkali metal nitrates and perchlorates, earth alkali metal nitrates and perchlorates, ammonium perchlorate and ammonium nitrate as well as mixtures thereof. However, other oxidizing agents such as, for example, organic nitro compounds or organic nitrates can also be used.

The stoichiometry of the reactants, i.e. the porous silicon and the oxidizer, can be set by means of the porosity. Stoichiometry, in turn, has influence on the release rate of energy and, hence, the reaction type which may vary between combustion, explosion and detonation. Moreover, the storage life can be prolonged through passivating the porous silicon by tempering in air.

The side faces of the core 112 are surrounded by a jacket 114 made of a solid semiconductor material in this embodiment as well. The core 112 and the jacket 114 are made of the same semiconductor material and are integrally formed. The jacket 114 preferably consists of solid silicon.

On the end face 116 of the core, there is an ignition element 118 that is located between electrically conductive contact surfaces 120. The contact surfaces have leads 122 for electric contacts. The ignition element 118 can be a semiconductor bridge or a thin layer element and, when current passes through, it triggers an ignition of the explosive material.

In the embodiment shown here, between the ignition element 118 or the electric contact surfaces 120 and the core 112 made of the explosive material, there is a membrane 126, that is to say, a thin layer that is only a few μm thick and that is made of a semiconductor material. The membrane 126 is made of the same semiconductor material as the core 112 and the jacket 114, and it is formed in one piece with them. However, the membrane can be dispensed with if the explosive material is stable vis-à-vis environmental influences. In this case, the ignition element 118 can be located directly on the core 112 made of the explosive material.

On the end face 124 of the core 112 opposite the end face 116, a cover 128 is joined by means of a bonded connection 130 with the jacket 114 or with the core 112 made of the explosive material. The cover is preferably made of silicon, glass, ceramic or metal. If the explosive material of the core 112 is stable vis-à-vis environmental influences, the cover can be dispensed with. In the embodiment shown here, the cover 128 is connected to the jacket 114 so as to be flush as well as gas-tight and liquid-tight.

Figure 7:
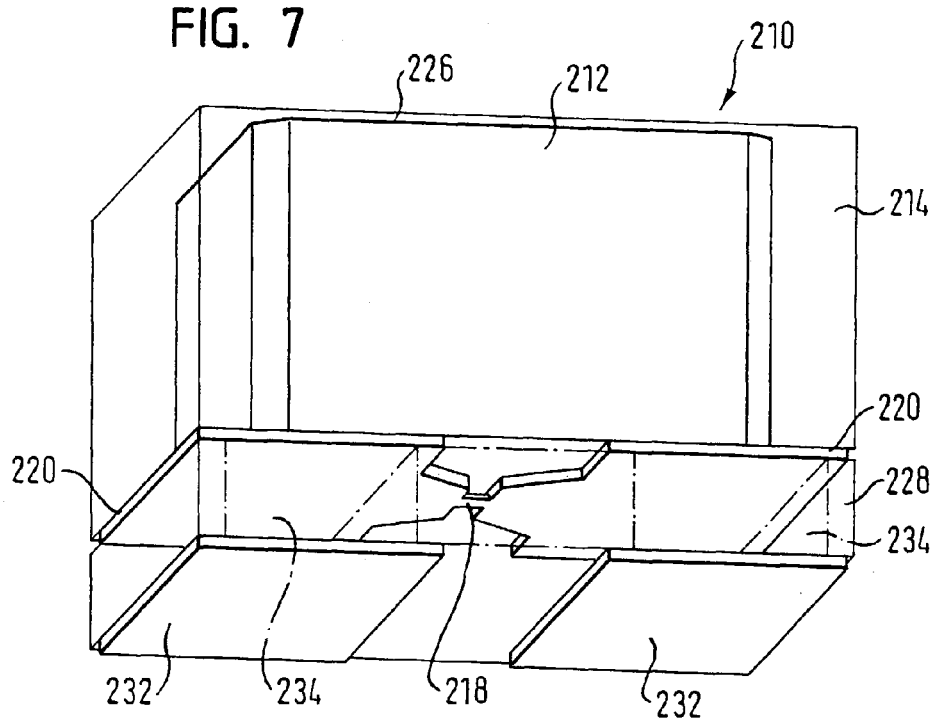
FIG. 7 is a schematic representation of another embodiment of the igniter according to the invention.
Figure 8:
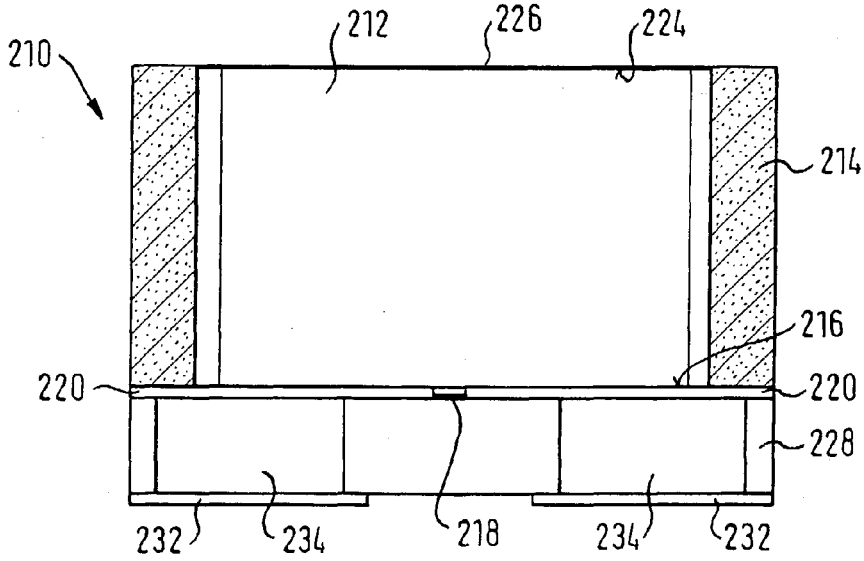
FIG. 8 shows the igniter according to the invention from FIG. 7 in a cross-section.

FIGS. 7 and 8 show another embodiment of the igniter 210 according to the invention. In this embodiment, one of the end faces 224 of the core 212, whose side faces are surrounded by a jacket 214 made of a solid semiconductor material, is sealed by a membrane 226. In this embodiment as well, the core 212 preferably is made of porous silicon having the properties described above, in the pores of which an oxidizing agent is incorporated. The membrane 226 is preferably made of the same solid semiconductor material as the jacket 214 and formed in one piece with it.

On the end face 216 of the core opposite the membrane 226, there are provided electric contact surfaces 220 between which there is an ignition element 218 which, when current passes through it, heats up suddenly, thus initiating the ignition of the explosive material made of the porous silicon and the oxidizing agent.

On the electric contact surfaces 220, there is a cover 228 that is made of silicon here or of another semiconductor material and that has outer contact surfaces 232 on its side opposite the electric contact surfaces 220. The outer contact surfaces 232 are electrically connected to the electric contact surfaces 220 via feedthroughs 234. Here, the ignition element 218 is situated on the inside of the cover 228. The cover 228 is joined to the semiconductor material of the jacket 214 by means of conventional bonding, adhesion or other joining techniques so as to be hermetically sealed. The electric contact surfaces 220 and the outer contact surfaces can be implanted or sputtered on. Moreover, the feedthroughs 234 and the outer contact surfaces 232 can also be formed by means of electrochemical deposition processes. The outer contact surfaces 232 can be contacted, for example, by means of a spring-loaded contact system (not shown here) with electrical leads.

In order to produce the igniters 10, 110, 210 according to the invention, wafers made of silicon or other semiconductor materials undergo an etching treatment in an electrolyte containing fluoride by means of known processes of the type described, for instance, in Physical Review Letters 87/6 (2001), pp. 068301/1 to 068301/4, or in WO-A-96/36990. The electrolyte is preferably a mixture of ethanol and aqueous hydrofluoric acid (50%) in a volume ratio in the range between 3:1 and 1:3. The current density of the anodizing current preferably ranges from 20 to 70 $mA/cm^2$. The wafer substrate can consist of n-doped, p-doped or undoped silicon. The doping can be weakly or highly concentrated. During the etching treatment, the wafer substrate can be irradiated in the known manner.

The etching treatment leads to the formation of a core of porous silicon with side walls made of solid silicon that surround this core and are integrally formed with the porous silicon. The etching treatment is preferably carried out in such a way that a small remaining wall thickness (membrane) of a few μm is left on one of the end faces of the core or of the wafer substrate due to a diffused-in etch stop. The substrate can optionally also be etched through.

Other production processes for porous semiconductor materials comprise chemical or physical deposition processes such as CVD, PVD, MOCVD, MBE or sputtering. In this case, the porous semiconductor material is deposited onto a carrier made of solid semiconductor material.

An oxidizer which is solid or liquid at room temperature is incorporated into the pores of the core made of porous semiconductor material. The incorporation can also be achieved by applying the oxidizing agent as a liquid or in solution and subsequently evaporating the solvent. Another conceivable approach is the application of the oxidizing agent as a melt and subsequent hardening in the pores of the porous silicon.

Using conventional silicon processing techniques, the wafer substrate can subsequently be provided with the contacts, it can be joined to the cover substrate by means of generally known joining techniques so as to be hermetically sealed, it can be cut into the desired size and finally contacted with the leads.

Alternatively, the wafer substrate can subsequently be cut into the desired size and the electric contact surfaces and contacts as well as, if applicable, the cover, can be mounted and joined to the semiconductor material.

The present invention allows the production of an effective igniter for use in gas generators, belt tensioners or other safety systems in vehicles by means of generally known process steps that can be carried out on an industrial scale and therefore cost-effectively. The selected pyrotechnical system is highly effective and therefore especially well-suited for miniaturization. The igniters according to the invention can easily be integrated into an existing semiconductor circuit.

The invention claimed is:

1. A component of a safety system in motor vehicles, said component comprising a core which has end and side faces and is made of an explosive material, a jacket made of a solid semiconductor that surrounds said explosive material on said side faces of said core, a membrane provided on one of said end faces of said core, and an ignition element situated between electric contact surfaces on either said membrane or another one of said end faces of said core opposite to said membrane, wherein said ignition element initiating an ignition of said explosive material when current flows through said ignition element, said explosive material consisting of a porous fuel and of an oxidizer incorporated into said porous fuel, said porous fuel and said solid semiconductor being made of the same material.

2. The component according to claim 1, wherein said membrane is made of a semiconductor material and formed in one piece with said jacket said jacket and said membrane being made of the same semiconductor materials.

3. The component according to claim 1, wherein said membrane is made of a semiconductor material formed in one piece with said jacket, said jacket and said membrane being made of different semiconductor materials.

4. The component according to claim 2, wherein said membrane is situated between said ignition element and said explosive material.

5. The component according to claim 1, wherein said ignition element is in direct contact with said explosive material.

6. The component according to claim 1, wherein a cover is provided and one of said ignition element and said explosive material is sealed gas-tight and liquid-tight by said cover.

7. The component according to claim 6, wherein said cover has a membrane-like design and a solid layer made of said semiconductor material of said jacket is arranged on one of said end faces lying opposite said cover, said layer having a thickness higher than that of said cover and being formed in one piece with said jacket.

8. The component according to claim 6, wherein said cover and said membrane are situated on said end faces which are arranged opposite each other.

9. The component according to claim 6, wherein said ignition element and said cover are situated on the same end face.

10. The component according to claim 9, wherein said ignition element is situated on an inside of said cover.

11. The component according to claim 6, wherein said cover is made of a semiconductor material selected from the group consisting of silicon, glass, ceramic and metal.

12. The component according to claim 6, wherein said cover is made of semiconductor material, preferably silicon, and has feedthroughs as well as outer contact surfaces.

13. The component according to claim 1, wherein said ignition element is one of a semiconductor bridge and a thin-film element.

14. The component according to claim 1, wherein said porous fuel is a nanostructured material having a structure size of nanocrystals that varies between 2 nm and 100 nm and a porosity that varies between 10% and 98%.

15. The component according to claim 1, wherein said porous fuel is a nanostructured material having a structure size of nanocrystals that varies between 2 nm and 50 nm.

16. The component according to claim 1, wherein said fuel has a specific surface area of up to 1000 $m^2/cm^3$.

17. The component according to claim 1, wherein said fuel is porous silicon.

18. The component according to claim 1, wherein said oxidizer is incorporated into pores of said porous fuel and is selected from the group consisting of hydrogen peroxide, hydroxyl ammonium nitrate, organic nitro compounds and nitrates, metal nitrates, metal nitrites, metal chlorates, metal perchlorates, metal bromates, metal iodates, metal oxides, metal peroxides, ammonium perchlorate, ammonium nitrate and mixtures thereof.

19. The component according to claim 1, wherein said oxidizer is selected from the group consisting of alkali metal nitrates and alkali metal perchlorates, earth alkali metal nitrates and earth alkali metal perchlorates, ammonium nitrate, ammonium perchlorate and mixtures thereof.

20. The component according to claim 19, wherein said oxidizer is one of an alkali metal nitrate and earth alkali metal nitrate, optionally in a mixture with ammonium perchlorate.

21. The component of claim 1, wherein said membrane consists of silicon dioxide.

22. The component of claim 1, wherein said ignition element does not contact said jacket.

* * * * *